US007061432B1

(12) United States Patent
Tavassoli Hozouri

(10) Patent No.: US 7,061,432 B1
(45) Date of Patent: Jun. 13, 2006

(54) COMPACT AND LOW PROFILE SATELLITE COMMUNICATION ANTENNA SYSTEM

(75) Inventor: Behzad Tavassoli Hozouri, Santa Clara, CA (US)

(73) Assignee: X-Ether, Inc., Santa Clara, CA (US)

( * ) Notice: Subject to any disclaimer, the term of this patent is extended or adjusted under 35 U.S.C. 154(b) by 0 days.

(21) Appl. No.: 11/160,162

(22) Filed: Jun. 10, 2005

(51) Int. Cl.
*H01Q 21/08* (2006.01)
*H01Q 1/38* (2006.01)

(52) U.S. Cl. ..... 343/700 MS; 343/757

(58) Field of Classification Search ..... 343/700 MS, 343/757, 824, 879, 878, 893; H01Q 21/08, H01Q 1/38
See application file for complete search history.

(56) References Cited

U.S. PATENT DOCUMENTS

| | | | | |
|---|---|---|---|---|
| 4,679,051 | A * | 7/1987 | Yabu et al. | 343/700 MS |
| 5,638,079 | A | 6/1997 | Kastner et al. | |
| 5,929,819 | A | 7/1999 | Grinberg | |
| 6,028,562 | A | 2/2000 | Guler et al. | |
| 6,127,985 | A | 10/2000 | Guler | |
| 6,509,881 | B1 | 1/2003 | Falk | |
| 6,839,039 | B1 | 1/2005 | Tanaka et al. | |
| 2001/0050634 | A1 * | 12/2001 | Laidig et al. | 343/700 MS |

FOREIGN PATENT DOCUMENTS

| | | | |
|---|---|---|---|
| WO | WO 01/11718 | A1 | 2/2001 |
| WO | WO 02/097919 | A1 | 12/2002 |
| WO | WO 2004/075339 | A2 | 9/2004 |

* cited by examiner

*Primary Examiner*—Hoanganh Le
(74) *Attorney, Agent, or Firm*—Raymond E. Roberts; Intellectual Property Law Offices

(57) ABSTRACT

An antenna for radio wave communications. A first antenna section of planar array type is provided that operates at a first frequency and first polarization. A second antenna section of planar array type is provided that at a second frequency and second polarization. At least one of the first and second frequencies and first and second polarizations are substantially different. A table is provided that has a substantially planar surface and a central axis. The first and second antenna sections are mounted in parallel on planar surface and with respect to the central axis so that rotation of the table about its central axis mechanically scans the antenna with about the central axis. The first and said second antenna sections also are mounted with a separation so that the first antenna section does not substantially overshadow the second antenna section when the antenna is handling the radio wave communications.

12 Claims, 1 Drawing Sheet

COMPACT AND LOW PROFILE SATELLITE COMMUNICATION ANTENNA SYSTEM

TECHNICAL FIELD

The present invention relates generally to radio wave antennas, and more particularly to such to concurrently handle either distinct frequency ranges, different signal polarizations, or both. It is anticipated that this invention will particularly be used with vehicle mounted satellite communications systems.

BACKGROUND ART

It has long been known to mount an antenna on top of a vehicle for communicating with a satellite. It is usually required that such antennas be steered in order to track satellite movement, for instance, to acquire new satellites as they come into view of the antenna and to compensate for motion of the vehicle carrying the antenna. To do these tasks antennas are steered either electronically or mechanically. Due to the high complexity and cost, however, fully electronically scanning an antenna is usually not the first (best) choice. More typically, a combination of mechanically and electronically scanning, or particularly fully mechanically scanning an antenna is the preferred choice.

Sometimes an antenna system contains both receiving and transmitting sections in which the relevant polarizations and/or frequencies are different. It may also be desirable that an antenna system have the capability of handling two different types of electromagnetic waves, e.g., circular polarization from TV satellites and linear polarization for internet connection with the same or another satellite.

For a single antenna to serve multiple of these purposes then requires complex feed networks and/or wideband radiating elements. The wideband radiating elements often do not have their best performance in the desired transmitting or receiving frequencies, particularly when used as a reflector antenna feed or elements of an array. For widely separated receiving and transmitting frequencies, e.g., 12 GHz and 14 GHz, relatively poor performance is then quite likely. Furthermore, placing one antenna on top of the other or placing two, or more, antennas side by side also increases the profile or antenna extent in the azimuth dramatically.

A single antenna using an interleaved array configuration of two different arrays may avoid the overall size issue, but increases complexity and manufacturing cost, as it becomes more than simply two antenna arrays. This also reduces the total efficiency by resorting to compact transmission lines which are relatively lossy. Some examples of such antenna designs are found in U.S. Pat. No. 6,028,562 by Guler et al. and its modified version in U.S. Pat. No. 6,127,985 by Guler.

U.S. Pat. No. 6,839,039 by Tanaka et al. discloses an antenna system using two distributed and generally planar arrays, one for receiving and the other for transmitting. Although this approach addresses some issues, it increases the complexity for the generally planar arrays by distributing them as single elements, or as a linear array of elements placed in parallel over a surface and distanced apart to prevent the antenna rows from overshadowing each other. Coherently combining the signals received from the receiver array partitions, and distributing the transmitting power between the relevant partitions over the desired frequency, therefore requires complex feed systems, particularly when there is a need for elevation scanning. On the other hand, the smaller the parts that the antenna is broken down into, e.g., single linear arrays, the larger the overall extension of the total antenna in the azimuth. This is mainly because the wider elevation beamwidth of the smaller parts then requires more distance between the adjacent rows of the elements or linear arrays to reduce their mutual coupling, which is especially an issue when a transmitting row is adjacent to a transmitting row.

U.S. Pat. No. 5,929,819 by Grinberg and Int. App. No. WO 01/11718 by Geller, WO 2004/075339 by Mansour et al., and WO 02/097919 by Collins are additional examples of this approach of resorting to distributed planar arrays. These references teach similar techniques and have similar problems to those discussed, and they do not cover the case of using two different antennas for transmitting and receiving.

In summary, the trend in this art has been to break down single antennas into smaller parts. Breaking down an antenna into similar but smaller antennas is normally done to increase the total gain for a given size constraint, if very low elevation angles are not to be covered. Simulations have indicated that for a given maximum height and diameter (in azimuth extent), the maximum total gain that can be obtained will be through breaking down the antenna into two parts.

Comparing some examples, however, it can be seen that the added gain is often neither considerable nor worth the added complexity and cost. Two cases can be compared, both using a minimum elevation angle of 20 degrees and operation in the Ku-band. For the first case a maximum antenna height of 6 inches and a diameter of 38 inches provides about 1.8 dB in extra gain, as compared to the single antenna with the maximum size to be placed in the same space. For the second case, a maximum antenna height of 5 inches and a diameter of 24 inches provides about 0.7 dB in extra gain. But the calculated benefits here are in an unrealistic ideal situation, i.e., 100% efficiency of the distribution network. Even using a highly difficult-to-obtain 80% efficiency reduces the total gain by about 1 dB, and when scanning in elevation is required over a wide bandwidth the maximum obtainable efficiency is even less, rendering very marginal benefits, if any. This approach of breaking down antennas causes difficult and expensive extra problems, such as a requirement to use a coherent distribution network, and inherently tends to add design and performance compromises.

Accordingly what is needed is a single overall antenna system that is suitable to concurrently handle either or both of two distinct frequency ranges and signal polarizations. This antenna system should preferably be compact and have a low profile, to facilitate mounting with low susceptibility to external forces like wind, rain, hail, etc., and particularly for exterior mounting on vehicles. This antenna system should also be suitable for rotation about at least one axis, driven by an essentially conventional mechanism, to mechanically scan the antenna system.

DISCLOSURE OF INVENTION

Accordingly, it is an object of the present invention to provide a single antenna system that is suitable to concurrently handle either or both of two distinct frequency ranges and signal polarizations.

Briefly, one preferred embodiment of the present invention is an antenna for radio wave communications. A first antenna section of planar array type is provided that operates at a first frequency and first polarization. A second antenna section of planar array type is provided that at a second frequency and second polarization. At least one of the first and second frequencies and first and second polarizations are substantially different. A table is provided that has a substantially planar surface and a central axis. The first and second antenna sections are mounted in parallel on planar surface and with respect to the central axis so that rotation of the table about its central axis mechanically scans the antenna with about the central axis. The first and said second antenna sections also are mounted with a separation so that the first antenna section does not substantially overshadow the second antenna section when the antenna is handling the radio wave communications.

An advantage of the present invention is that it is efficient, integrating into a single structure two antennas that handle what heretofore has required totally distinct systems or requiring fractionalized systems that are inherently subject to design compromises that undermine efficiency.

Another advantage of the invention is that it is compact and has a low profile, thus making the present invention suitable for use where external forces present a for abuse and damage and especially making the present invention suitable for use in vehicle based applications.

And another advantage of the invention is that it is suitable for rotation about at least one axis by an essentially conventional mechanism to mechanically scan the antenna system.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended figures of drawings in which.

In the various figures of the drawings, like references are used to denote like or similar elements or steps.

BEST MODE FOR CARRYING OUT THE INVENTION

Figure 1:
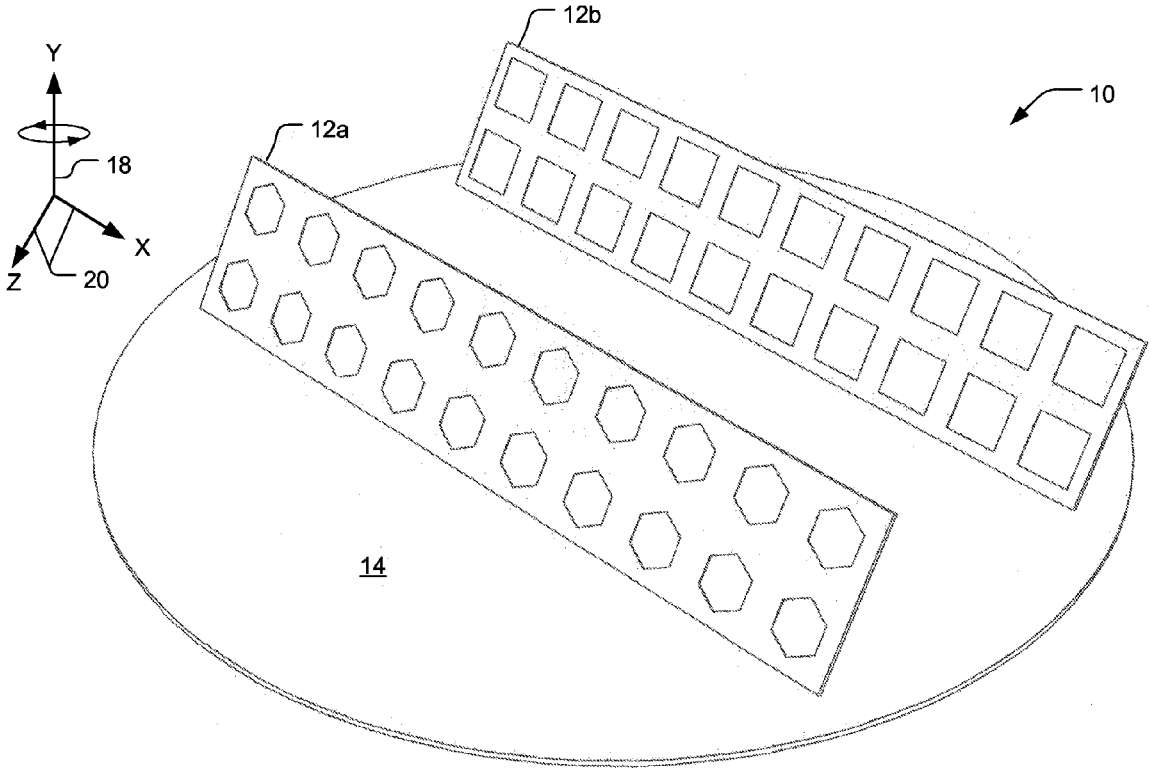
FIG. 1 is a perspective view schematically illustrating the overall construction of an antenna in accord with the present invention.

A preferred embodiment of the present invention is an antenna that is compact and low profile, and especially suitable for satellite communications. As illustrated in the various drawings herein, and particularly in the view of FIG. 1, preferred embodiments of the invention are depicted by the general reference character 10.

Figure 2:
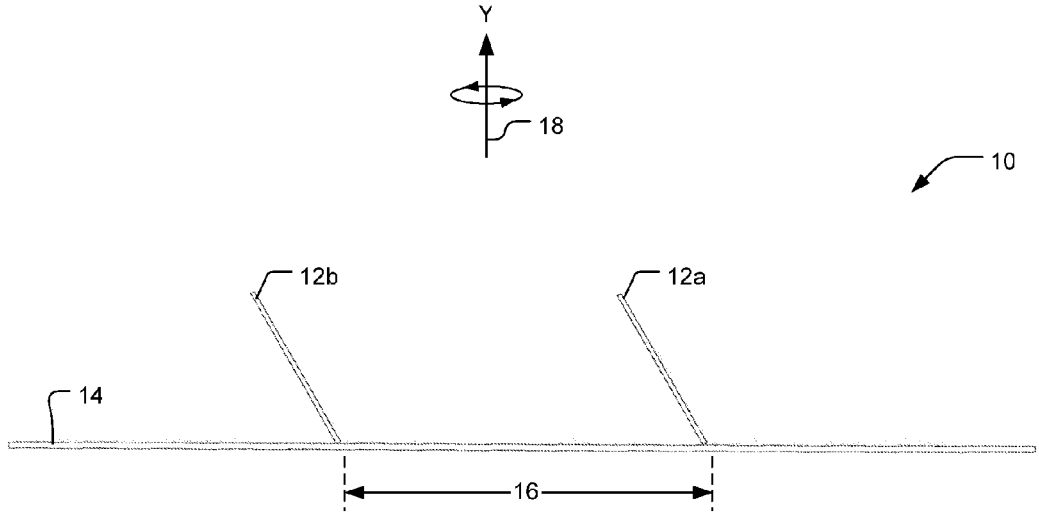
FIG. 2 is a side view of the antenna of FIG. 1.

FIG. 1 is a perspective view which schematically illustrates an antenna 10 in accord with the present invention, and FIG. 2 is a side view of the antenna 10 of FIG. 1. The antenna 10 includes a first antenna section 12*a* and a second antenna section 12*b*. Both of the antenna sections 12*a–b* can be directed towards a potential communication target, e.g., a the satellite, by control of the antenna 10 as a whole.

The antenna sections 12*a–b* are of planar array type, but otherwise can be completely different types with respect to their ability to handle different frequencies or signal polarizations, and accordingly they can have different sizes and shapes to fulfill their respective roles (FIG. 1 particularly illustrates that the antenna sections 12*a–b* can be markedly different). It is anticipated that the antenna sections 12*a–b* will often be used, respectively, as transmitter and receiver sections. As was discussed in the Background section, using a single antenna for widely separated receiving and transmitting frequencies often severely compromises performance to achieve a design that encompasses both frequencies. Thus, for example, the first antenna section 12*a* can be designed to optimally handle 12 GHz transmission and the second antenna section 12*b* can be designed to optimally handle 14 GHz reception. Alternately, the antenna sections 12*a–b* can be used as transmitter-receiver sections or as two transmitter sections or two receiver sections. For example, the first antenna section 12*a* can be designed to handle a linear polarized bi-directional internet connection with a satellite, and the second antenna section 12*b* can be designed to handle circular polarized TV signals from a satellite.

The antenna sections 12*a–b* are mounted substantially parallel on a table 14. The mounted antenna sections 12*a–b* are also substantially plainarly parallel when communicating with a single target, but this is not a requirement otherwise. For instance, when only the rear antenna section 12*b* is working the front antenna section 12*a* can be rotated in elevation, say, toward the zenith (i.e., parallel to the azimuth plane), to minimize its overshadowing effect on the rear antenna section 12*b*. The antenna sections 12*a–b* are also mounted with a separation 16 sufficient to avoid any appreciable overshadowing effect in the particular application. The distance of this separation 16 can be calculated using conventional methods. For example, there are approximate formulas for this based on geometric optics approximations. In cases where there is no need for coverage of very low elevation angles, the separation 16 can be less, and this particularly permits making the antenna 10 compact.

In case of where the antenna sections 12*a–b* are used as transmitter and receiver sections, the transmitter section can be placed in front of the receiver section to reduce coupling. This is not a requirement, however, since isolation can also be obtained by using filters/diplexers in the case of different frequencies. Also, when one antenna section 12*a–b* has a lower profile it can be placed in front of the other to minimize the overall extent that it overshadows the other antenna section 12*a–b*.

The table 14 is rotatable, in conventional manner, permitting the antenna 10 to be mechanically steered in one axis 18 and mechanically or electronically in another axis 20, e.g., to be steered mechanically in azimuth and either electronically or mechanically in elevation. If the antenna 10 is applied so that the table 14 is rotatable to facilitate azimuth scanning, the number of mechanical driving system parts is reduced. Electrical scanning in elevation can then be used, or additional mechanical apparatus, e.g., motor and drive cord or belt, etc., can be provided and connected outside or behind the antenna 10.

In summary, the present invention is about using two generally planar antennas, rather than breaking down single antennas into smaller parts. This approach provides advantages without the extra issues that come with handling antennas as smaller parts. As has been discussed above, each antenna section 12*a–b* of the total antenna 10 should be independent, e.g., one section acting as a transmitting antenna and the other as the receiving antenna.

While various embodiments have been described above, it should be understood that they have been presented by way of example only, and that the breadth and scope of the invention should not be limited by any of the above described exemplary embodiments, but should instead be defined only in accordance with the following claims and their equivalents.

What is claimed is:

1. An antenna for radio wave communications, comprising:

a first antenna section of unitary form and of planar array type to operate at a first frequency and a first polarization;

a second antenna section of unitary form and of planar array type to operate at a second frequency and a second polarization, wherein at least one set consisting of said first frequency and said second frequency and said first polarization and said second polarization are substantially different;

a table having a substantially planar surface and a central axis;

said first antenna section and said second antenna section mounted in parallel on said planar surface and with respect to said central axis such that rotation of said table about said central axis mechanically scans the antenna with respect to said central axis; and said first antenna section and said second antenna section also mounted with a separation such that said first antenna section does not substantially overshadow said second antenna section when handling the radio wave communications.

2. The antenna of claim 1, wherein said first antenna section transmits the radio wave communications and said second antenna receives the radio wave communications, thereby reducing coupling into said second antenna section from said first antenna section of the radio wave communications that are transmitted.

3. The antenna of claim 1, wherein said first antenna section operates optimally at said first polarization to transmit the radio wave communications at said first polarization and said second antenna operates optimally at said second polarization to receive the radio wave communications at said second polarization.

4. The antenna of claim 1, wherein said first antenna section operates optimally at said first frequency to transmit the radio wave communications at said first frequency and said second antenna operates optimally at said second frequency to receive the radio wave communications at said second frequency.

5. The antenna of claim 1, wherein said first antenna section is shorter than said second antenna section with respect to said central axis, thereby reducing said separation.

6. The antenna of claim 1, wherein said table rotates about the azimuth and wherein said separation is based on a minimum elevation of a target with which the antenna conducts the radio wave communications and a geometric optics approximation that produces no overshadowing effect between said first antenna section and said second antenna section.

7. An antenna for radio wave communications, comprising:

first antenna-section means of unitary form and of planar array type for operation at a first frequency and a first polarization;

second antenna-section means of unitary form and of planar array type for operation at a second frequency and a second polarization, wherein at least one set consisting of said first frequency and said second frequency and said first polarization and said second polarization are substantially different;

table means having a substantially planar surface and a central axis;

said table means for mounting first antenna-section means and said antenna-section means in parallel on said planar surface and with respect to said central axis such that rotation of said table means about said central axis mechanically scans the antenna with respect to said central axis; and said table means further for mounting said first antenna-section means and said second antenna-section means with a separation such that said first antenna-section means does not substantially overshadow said second antenna-section means when handling the radio wave communications.

8. The antenna of claim 7, wherein said first antenna-section means is for transmitting the radio wave communications and said second antenna-section means is for receiving the radio wave communications, thereby reducing coupling into said second antenna-section means from said first antenna-section means of the radio wave communications that are transmitted.

9. The antenna of claim 7, wherein said first antenna-section means is for operating optimally at said first polarization to transmit the radio wave communications at said first polarization and said second antenna-section means is for operating optimally at said second polarization to receive the radio wave communications at said second polarization.

10. The antenna of claim 7, wherein said first antenna-section means is for operating optimally at said first frequency to transmit the radio wave communications at said first frequency and said second antenna-section means is for operating optimally at said second frequency to receive the radio wave communications at said second frequency.

11. The antenna of claim 7, wherein said first antenna-section means is shorter than said second antenna antenna-section means with respect to said central axis, thereby reducing said separation.

12. The antenna of claim 7, wherein said table means rotates about the azimuth and said separation is based on a minimum elevation of a target with which the antenna conducts the radio wave communications and a geometric optics approximation that produces no overshadowing effect between said first antenna-section means and said second antenna-section means.

* * * * *